US007913758B2

(12) United States Patent
Wheller et al.

(10) Patent No.: US 7,913,758 B2
(45) Date of Patent: Mar. 29, 2011

(54) OIL WELL PERFORATORS AND METHOD OF USE

(75) Inventors: Stephen Wheller, Kent (GB); Michael R Hoar, Kent (GB)

(73) Assignee: Qinetiq Limited, London (GB)

( * ) Notice: Subject to any disclaimer, the term of this patent is extended or adjusted under 35 U.S.C. 154(b) by 172 days.

(21) Appl. No.: 11/667,655

(22) PCT Filed: Nov. 15, 2005

(86) PCT No.: PCT/GB2005/004374

§ 371 (c)(1),
(2), (4) Date: May 14, 2007

(87) PCT Pub. No.: WO2006/054052

PCT Pub. Date: May 26, 2006

(65) Prior Publication Data

US 2008/0041592 A1 Feb. 21, 2008

(30) Foreign Application Priority Data

Nov. 16, 2004 (GB) ..... 0425216.9

(51) Int. Cl.
*E21B 43/26* (2006.01)

(52) U.S. Cl. ..... 166/259; 166/271; 166/55; 166/297; 102/310

(58) Field of Classification Search ..... 166/259, 166/271, 281, 55, 308.1, 297; 102/306–310; 175/4.55; 89/1.15, 1.151
See application file for complete search history.

(56) References Cited

U.S. PATENT DOCUMENTS

| | | | | | |
|---|---|---|---|---|---|
| 2,867,172 | A | * | 1/1959 | Hradel | 102/310 |
| 2,928,658 | A | * | 3/1960 | Miner | 175/4 |
| 3,043,379 | A | * | 7/1962 | Porter et al. | 175/4 |
| 3,089,416 | A | | 5/1963 | Gilbert | |
| 3,241,488 | A | | 3/1966 | Glass | |
| 3,347,314 | A | * | 10/1967 | Schuster | 166/286 |
| 3,347,315 | A | | 10/1967 | Lanmon | |

(Continued)

FOREIGN PATENT DOCUMENTS

GB 2 028 473 3/1980

OTHER PUBLICATIONS

GB Search Report of GB0425216.9, dated Mar. 4, 2005.

(Continued)

*Primary Examiner* — William P Neuder
*Assistant Examiner* — Cathleen R Hutchins
(74) *Attorney, Agent, or Firm* — Nixon & Vanderhye P.C.

(57) ABSTRACT

A method for completing an oil and gas well completion is provided. The perforators (10, 11) may be selected from any known or commonly used perforators and are typically deployed in a perforation gun. The perforators are aligned such that the cutting jets (12, 13) and their associated shock-waves converge towards each other such that their interaction causes increased fracturing of the rock strata. The cutting jets may be also be aligned such that the cutting jets are deliberately caused to collide causing further fracturing of the rock strata. In Ian alternative embodiment of the invention there is provided a shaped charge liner with at least two concave regions, whose geometry is selected such that upon the forced collapse of the liner a plurality of cutting jets is formed which jets are convergent or are capable of colliding in the rock strata.

12 Claims, 4 Drawing Sheets

U.S. PATENT DOCUMENTS

| | | | | |
|---|---|---|---|---|
| 3,630,282 | A | 12/1971 | Lanmon | |
| 3,695,368 | A | 10/1972 | Lanmon | |
| 4,105,073 | A | 8/1978 | Brieger | |
| 4,193,460 | A | 3/1980 | Gilbert | |
| 4,756,371 | A | 7/1988 | Brieger | |
| 5,320,044 | A | 6/1994 | Walters et al. | |
| 5,320,174 | A * | 6/1994 | Terrell et al. | 166/297 |
| 5,377,594 | A * | 1/1995 | Alford | 102/308 |
| 6,494,139 | B1 | 12/2002 | Powell | |
| 2005/0194146 | A1 | 9/2005 | Barker et al. | |
| 2005/0194181 | A1 | 9/2005 | Barker et al. | |

OTHER PUBLICATIONS

International Search Report of PCT/GB2005/004374, filed Feb. 6, 2006.

* cited by examiner

OIL WELL PERFORATORS AND METHOD OF USE

This application is the US national phase of international application PCT/GB2005/004374, filed 15 Nov. 2005, which designated the U.S. and claims priority of GB 0425216.9, filed 16 Nov. 2004, the entire contents of each of which are hereby incorporated by reference.

The present invention relates to a method of arranging shaped charge devices that are extensively used in perforating and fracturing oil or gas well completions.

By far the most significant process in carrying out a completion in a cased well is that of providing a flow path between the production zone, also known as a formation, and the well bore. Typically, when employing the use of a perforator, upon initiation of the device the cutting jet creates an aperture in the casing or casings and then proceeds to penetrate into the formation via a cementing layer. This whole process is commonly referred to as a perforation. Although mechanical perforating devices are known, almost overwhelmingly such perforations are formed by using shaped charge devices because they are efficient, readily deployable and are capable of multiple perforations, for example 30,000 or more may be used in one completion. Energetic devices can also confer additional benefits in that they may provide stimulation to the well in the sense that the shock wave passing into the formation can enhance the effectiveness of the perforation and produce an increased flow from the formation. Typically, such a perforator will take the form of a shaped charge, also known as a hollow charge. In the following, any reference to a perforator, unless otherwise qualified, should be taken to mean a shaped charge perforator.

A shaped charge is an energetic device made up of a casing or housing, usually cylindrical, within which is placed a relatively thin metallic liner. The liner provides one internal surface of a void, the remaining surfaces being provided by the housing. The void is filled with energetic explosive material which, when detonated, causes the liner material to collapse and be ejected from the housing in the form of a high velocity jet of material. This jet impacts upon the well casing creating an aperture, the jet then continues to penetrate into the formation itself, until the jet is consumed by the "target" materials in the casing, cement and formation. The liner may be hemispherical but in most perforators the shape is generally conical. Conventionally the shaped charge housing will be manufactured from steel or aluminium alloy, although other ferrous and non ferrous alloys may be preferred. In use, as has been mentioned the liner forms a very high velocity jet that has great penetrative power.

Generally, a large number of perforations are required in a particular region of the casing proximate to the formation. To this end, a so called gun is deployed into the casing by wireline, coiled tubing or indeed any other technique known to those skilled in the art. The gun is effectively a carrier for a plurality of perforators that may be of the same or differing output. The precise type of perforator, their number and the size of the gun are a matter generally decided upon by a completion engineer, based on an analysis and/or assessment of the characteristics of the completion. Generally, the aim of the completion engineer is to obtain the largest possible aperture in the casing together with the deepest possible penetration into the surrounding formation. It will be appreciated that the nature of a formation may vary both from completion to completion and also within the extent of a particular completion.

Typically, the selection of the perforating charges, their number and arrangement within a gun and indeed the type of gun is decided upon by the completion engineer, who will base his decision on an empirical approach born of experience and knowledge of the particular formation in which the completion is taking place. However, to assist the engineer in his selection a range of tests and procedures have been developed for the characterisation of an individual perforator's performance. These tests and procedures have been developed by the industry via the American Petroleum Institute (API). For deep hole perforators the API standard RP 19B (formerly RP 43 5$^{th}$ Edition) currently available for download from www.api.org is used widely by the perforator community as an indication of perforator performance. Manufacturers of perforators typically utilise this API standard for marketing their products. The completion engineer is therefore able to select between products of different manufacturers for a perforator having the performance they believe is required for the particular formation. In making the selection, the engineer can be confident of the type of performance that might be expected from the selected perforator.

Nevertheless, despite the existence of these tests and procedures it is recognised that completion engineering remains at heart more of an art than a science. It has been recognised by the inventors in respect of the invention set out herein, that the conservative nature of the current approach to completion has failed to bring about the change in the approach to completion engineering required, to enhance and increase production from both straightforward and complex completions.

There is a requirement in the oil and gas completion industry, to produce both deep hole (DP) perforators and big hole perforators. Different, completions have different geology. At one end of the scale there are consolidated hard rock formations that require a large amount of highly focussed jet energy to perforate. Deep hole perforators as their name implies, are intended to provide the deepest possible hole, to penetrate as far as possible into the formation and are generally used where the formation consists of hard rock.

At the other end of the scale there are unconsolidated formations, that is loose fill material, for example sand, which is easy to displace but may readily collapse with the passage of time. Big hole perforators are intended to provide the largest possible entry hole in the casing(s). The increased diameter of the entry holes in the casing improve the placement of sand in the perforation tunnels and help to reduce the pressure drop through each individual perforation tunnel to provide improved flow characteristics, and so produce the greatest flow of hydrocarbons per unit area and also to increase well reliability.

The metric for the flow of material from a perforation in a completion, is characterised by the entry hole diameter and the inflow of hydrocarbon per linear foot of gun casing.

There is a dichotomy in the industry, as to the optimum way to increase the flow of hydrocarbons, ie whether to use a big hole perforator or a deep hole perforator. The drawbacks of a deep hole perforator are mainly that the hole created by the cutting jet is narrow and tapers in at the tip of the jet. The hole that is produced is usually very clean almost as though it had been drilled, which keeps the pressure in the completion high, but with a relatively low flow rate. In contrast the big hole perforator allows a large flow per unit area, however the depth of penetration is very limited.

Ideally it is desirable to create the maximum possible flow per unit area from each perforation and to also to ensure that the perforation is as deep as possible. One approach is to use a tandem perforator i.e. one liner directly behind the other, although this can have its own associated cost implications and, there are constraints on the size of the perforator in this set up, as the perforators will typically be mounted in the aforementioned carrier gun arrangement and so their diameter and length will be constrained such that they will fit into the gun. Similarly there is a constraint on the mass of explosive in each perforator, as it may be necessary for the gun to survive the detonations and be removed from the completion, to increase the flow of hydrocarbon material.

Applicants have found that by angling the adjacent perforators to provide convergent jets a method of completing an oil or gas well using a plurality of shaped charge perforators, wherein conventional perforators are used but are arranged so as to cause increased disruption to the completion as compared to conventional arrangements.

According to the present invention therefore a method of completing an oil or gas well using a plurality of shaped charge perforators, wherein at least two of said perforators are arranged to produce cutting jets which are convergent. Preferably the angle of convergence may be in the range of 1 to 179 degrees, even more preferably 5 to 60 degrees.

It will be readily appreciated that more than two perforators could be used to provide the convergent cutting jets and as such any mention of two perforators does not preclude the use of three or more perforators, however a limiting factor for the actual number of perforators may be the space available in the perforation gun.

Factors which typically determine the performance of the perforator are the liner geometry and the type and mass of high explosive used. However the actual final length of the cutting jet and hence the depth of perforation will also depend on the geology of the completion. It will be readily appreciated by those skilled in the art as to the approximate depth of penetration and hence the likely final length or maximum extent of the cutting jet for any given perforator in a given completion. Therefore all references to the cutting jet's final length herein described will refer to the final length as would be judged by the skilled completion engineer could be achieved. By the "path of the jet" as referred to hereinafter is meant the channel which is actually formed in the rock strata as a result of the action of the cutting jet. This can be increased if the jets are arranged to actually collide within the formation The skilled man will readily appreciate that the amount of energy released from the collision of the two cutting jets will decrease in relation to the distance the that the collision point occurs from the source of the shaped charge devices. Further there is also a desire to ensure that any given cutting jet penetrates as deeply as possible into the completion, to release the maximum possible amount of hydrocarbons. However this has to be balanced against a requirement that the cutting jets should still possess sufficient momentum at the point of collision as to be able to cause the desired amount of disruption of the formation to release sufficient energy into the rock strata. Therefore the skilled man will be able to select the appropriate angle of convergence for the two shaped charge devices to ensure that in operation, the jets formed converge at the most desirable point.

Therefore in one arrangement according to the present invention, two or more perforators may be aligned such that in operation, their jets converge towards each other, but do not meet as the point of intersection is after the final length of the jet. Alternatively the jets converge such that the paths of the jets intersect at a point before their final length is reached, or in yet a further alternative arrangement the perforators may be aligned such that the resulting paths of the jets intersect substantially at a point corresponding to their final length. Where the at least two jet paths, at the point of intersection, an increased amount of localised damage is expected to be produced.

Consequently whether or not the cutting jets actually collide or is achieved by selecting an appropriate time interval between the subsequent initiation of individual perforators. It will be clear that the time interval between subsequent detonations of the converging perforators can be selected to ensure that the jets either do not collide and thus providing the maximum possible penetration depth to occur for each given perforator. Alternatively the jets may be fired at the same time or at such an interval as to ensure that not only do the jet paths intersect but also that the jets actually collide with each other to further increase the perforation damage at the point of intersection and collision and thus creating a large degree of fracturing in the rock strata proximate to the collision of the cutting jets.

It will be clear to the skilled person as to the required time delay between the initiation of each individual perforator in order to achieve the collision of the jets, such factors that will be considered are perforator type hence the likely energy and velocity of the cutting jet, the geology of the completion and the relative distance that each jet will have to travel in order to collide.

The collision of the cutting jets, will result in their large momentum being imparted to the surrounding rock strata and thus causing a large cavity to be formed at the point of intersection, allowing for a greater flow of hydrocarbon from the completion.

The depth of penetration into the completion is a critical factor in completion engineering, and thus it is usually desirable to fire the perforators perpendicular to the casing to achieve the maximum penetration and typically also perpendicular to each other to achieve the maximum depth per shot. Therefore in a preferred mode of this invention at least one of the perforators is aligned perpendicular to the casing to ensure maximum perforation depth and at least one further perforator is aligned such that the cutting jet will converge, intersect or collide at some point with the first perpendicularly fired cutting jet.

The at least two perforators may be located in the same plane, for example the x, y Cartesian plane, where it is easy to visualise convergence, intersection or collision, however in an alternative arrangement the at least two perforators may not be located in the same plane and possess different x, y and z co-ordinates.

The at least two perforators may be arranged such that in use the perforators are spaced less than 3 charge diameters apart. Although the spacing between converging perforators may be greater than 3 charge diameters, achieving a useful depth of perforation may be significantly compromised. In order to achieve very narrow angles of convergence say typically less than 10 degrees the perforators may be located less than one half charge diameter apart. This may be achieved by placing one perforator substantially behind and to the side of the other perforator.

The perforators as hereinbefore described may be inserted directly into any subterranean well, however it is usually desirable to incorporate the perforators into a gun as previously described, in order to allow a plurality of perforators to be deployed into the completion.

Therefore according to a second aspect of the invention there is provide a perforation gun comprising a plurality of oil and gas perforators, wherein at least two of said oil and gas perforators are configured such that in use the cutting jets produced by said at least two perforators are convergent. Preferably the angle of convergence may be in the range from 1 to 179 degrees, even more preferably the angle of convergence is in the range of from 5 to 60 degrees.

In a third aspect of the invention there is provided an oil and gas perforator liner which comprises at least two concave regions, such that in use the liner produces at least two cutting jets which are convergent. Preferably the angle of convergence may be in the range from 1 to 30 degrees, even more preferably the angle of convergence is in the range of from 5 to 20 degrees. It will be readily appreciated by those skilled in the art that the number of such concave regions is only limited by the physical diameter dimension of the perforator, and further that the shape of such concave regions may be selected from any known design, such as for example conical or hemispherical. Such a liner may be produced from commonly used shaped charge liner materials, such as copper and/or tungsten or their alloys and may be manufactured using any known method, for example by pressing particulate powders, shear forming or machining.

In use a liner according to the invention may produce a plurality of cutting jets which may be arranged such that the jet paths converge, intersect or are arranged such that the jets will collide. Upon detonation the multiple concave regions will be forced to collapse at substantially the same time, thus increasing the likelihood of producing a number of jets which are capable of collision. In one arrangement it may be desirable that at least one of the concave regions is substantially perpendicular to the completion casing, to increase the depth of perforation.

According to a fourth aspect of the present invention there is provided a shaped charge perforator comprising a housing, a high explosive, a liner comprising at least two concave regions, wherein the high explosive is positioned between the liner and the housing.

As described earlier it is usually desirable to incorporate a plurality of shaped charges into a perforation gun in order to aid deployment of a large number of perforators into the completion. It will be clear that the at least two concave region perforators may be used in isolation or in combination with other commonly used perforators, such as to provide a synergistic effect of maximum perforation combined with the increased damage that converging, intersecting or colliding jets provide.

In typical oil and gas perforator use, a perforation gun is set up to fire each perforator essentially perpendicular to the casing to ensure maximum penetration, and the perforators are located in a helical arrangement in the gun. It may be desirable to incorporate one or more further helices of perforators to produce a double or triple etc helix, such that perforator number 1 of the second helix is located directly above perforator number one of the first helix etc, in order to provide at least two perforators for each given position around the circumference of the gun. It will be clear that any number of helices may be employed for any given gun arrangement, subject only to there being a balance between the number of shots per 360 degrees and the number of shots per unit length of gun. According to the present invention in such a gun arrangement, pairs or groups of perforators sharing a common position in the gun circumference are arranged such that the jet paths of such perforators will converge, intersect or such that the jets will collide According to a fifth aspect of the present invention there is provided a method of completing an oil or gas well using one or more perforation guns according to the present invention.

According to a sixth aspect of the present invention there is provided a method of completing an oil or gas well using a one or more perforator liners, according to any the present invention.

According to a seventh aspect of the present invention there is provided a method of completing an oil or gas well using one or more shaped charge perforators according to the present invention.

According to a eighth aspect of the present invention there is provided a method of completing an oil or gas well using one or more shaped charge perforators according to the present invention.

According to a ninth aspect of the present invention there is provided a method of improving fluid outflow from a well comprising the step of perforating the well using a method, a perforation gun, a perforator liner, a shaped charge perforator, or a perforation gun according to the present invention.

In order to assist in understanding the invention, a number of embodiments thereof will now be described, by way of example and with reference to the accompanying drawing, in which.

Figure 1:
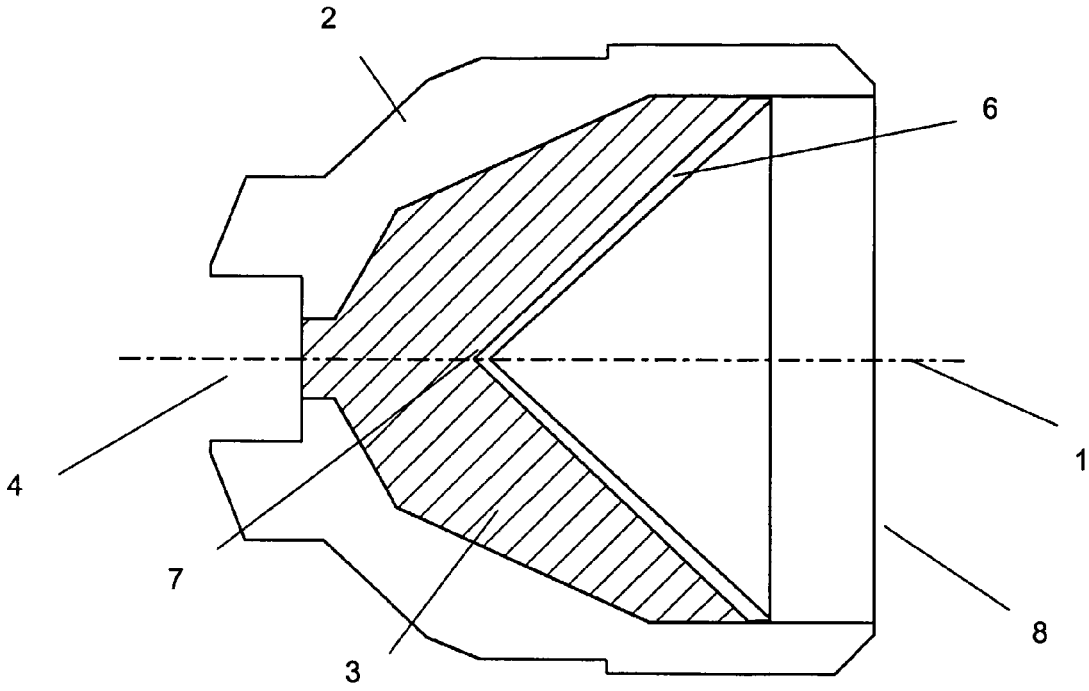
FIG. 1 is a cross-sectional view along a longitudinal axis of a shaped charge device.

As shown in FIG. 1 a cross section view of a shaped charge, typically axi-symmetric about centre line 1, of generally conventional configuration comprises a substantially cylindrical housing 2 produced from a metal, polymeric or GRP material. The liner 6 according to the invention, typically of say 1 to 5% of the liner diameter as wall thickness but may be as much as 10% in extreme cases. The liner 6 fits closely in the open end 8 of the cylindrical housing 2. High explosive material 3 is located within the volume enclosed between the housing and the liner. The high explosive material 3 is initiated at the closed end of the device, proximate to the apex 7 of the liner, typically by a detonator or detonation transfer cord which is located in recess 4.

A suitable starting material for the liner may comprise a stoichiometric mixture of nano-crystalline powdered nickel and aluminium with a 1 to 5% by weight of nano-crystalline powdered binder material. The binder material comprises polymeric materials including energetic binders as described before. The nano-crystalline powder composition material can be obtained via any of the above mentioned processes.

One method of manufacture of liners is by pressing a measure of intimately mixed and blended powders in a die set to produce the finished liner as a green compact. In other circumstances according to this patent, differently, intimately mixed powders may be employed in exactly the same way as described above, but the green compacted product is a near net shape allowing some form of sintering or infiltration process to take place.

Figure 2:
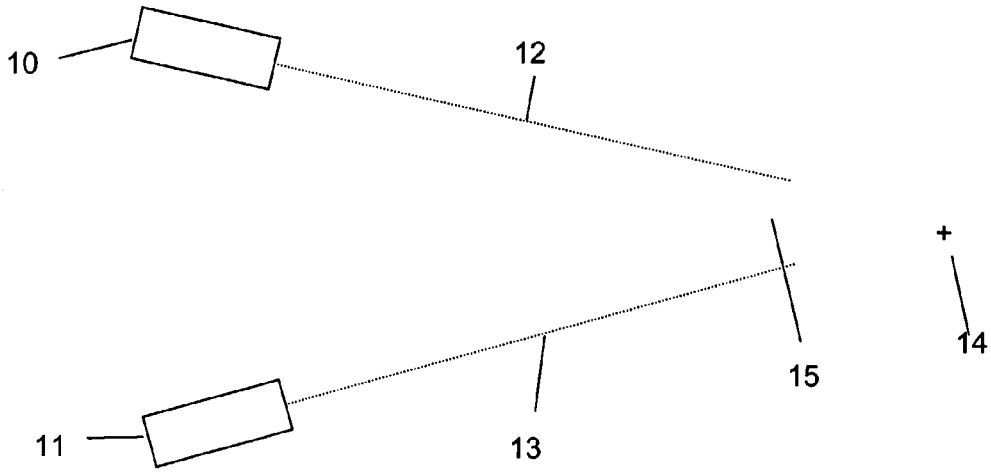
FIG. 2 is a plan view of a pair of shaped charge devices arranged such that in use the cutting jets converge but do not intersect.

As shown in FIG. 2, two shaped charge devices 10 and 11 of a generally conventional configuration as shown in FIG. 1, upon initiation produce cutting jets 12 and 13 respectively. In this configuration the shaped charges 10 and 11 are directed towards each other to afford a convergence angle 15, such that cutting jets 12 and 13 converge towards each other. In this arrangement the paths created in the completion by the action of the cutting jets 12 and 13 meet at point 14, which occurs beyond the final length or maxim extent of the cutting jet.

Figure 3:
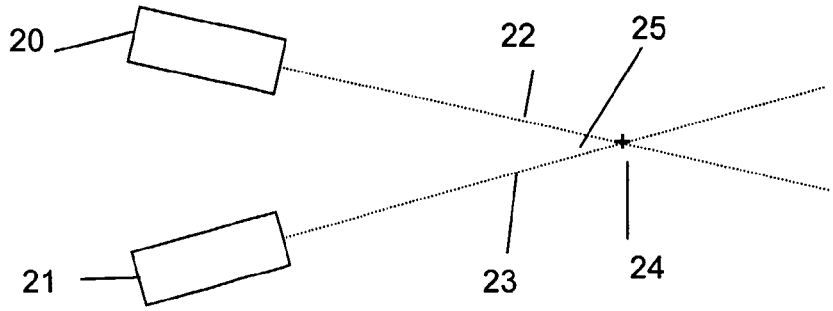
FIG. 3 is a plan view of a pair of shaped charge devices arranged such that in use the cutting jets converge and intersect at a point before the maximum extent of the cutting jet has been reached.

As shown in FIG. 3 two shaped charge devices 20 and 21 of a generally conventional configuration as shown in FIG. 1, upon initiation produce cutting jets 22 and 23 respectively. In this configuration the shaped charges 20 and 21 are directed towards each other to afford a convergence angle 25, such that the cutting jets 22 and 23 converge and either cross over or collide at point 24 which occurs before the final length of the cutting jet has been achieved. If the shaped charge devices 20 and 21 are initiated at different time intervals then the cuttings jets 22 and 23 will not collide, but their respective paths will cross over at point 24. Alternatively if the devices 20 and 21 are initiated at substantially the same time then the cutting jets 22 and 23 will collide at point 24.

Figure 4:
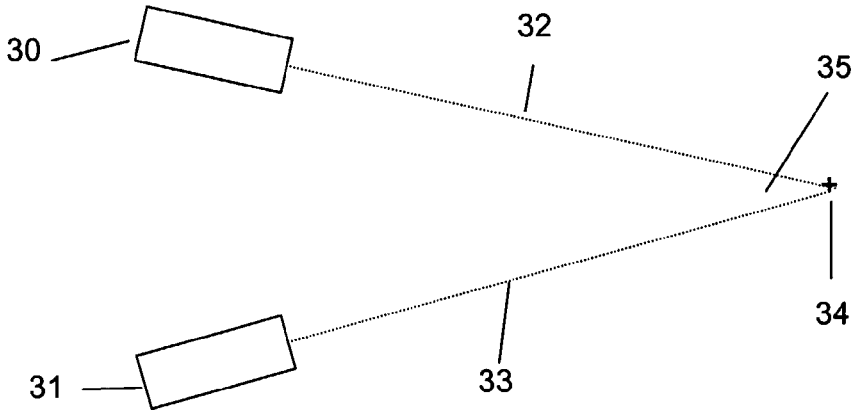
FIG. 4 is a plan view of a pair of shaped charge devices arranged such that in use the cutting jets converge and intersect at a point substantially at the maximum extent of the cutting jet.

As shown in FIG. 4 two shaped charge devices 30 and 31 of a generally conventional configuration as shown in FIG. 1, upon initiation produce cutting jets 32 and 33 respectively. In this configuration the shaped charges 30 and 31 are inclined towards each other to afford a convergence angle 35, such that the cutting jets 32 and 33 intersect or collide at point 34 which occurs at substantially the final length of the cutting jet.

Figure 5:
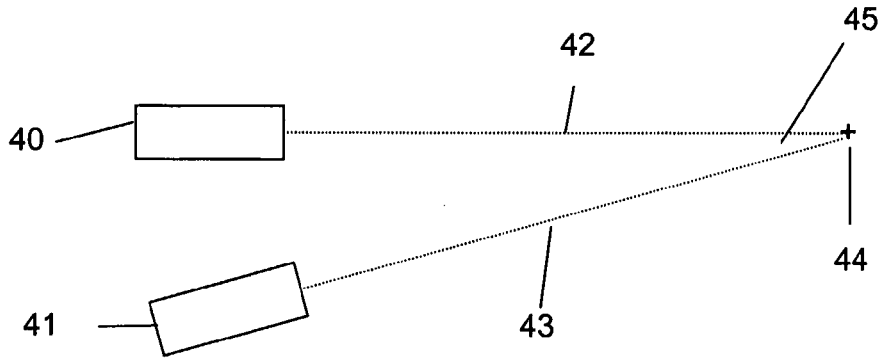
FIG. 5 is a plan view of a pair of shaped charge devices arranged such that in use the at least one of the cutting jets is perpendicular to the completion and the second jet is arranged such that it will converge and intersect at a point substantially at the maximum extent of the cutting jet.

As shown in FIG. 5 two shaped charge devices 40 and 41 of a generally conventional configuration as shown in FIG. 1, which upon initiation produce cutting jets 42 and 43 respectively. In this configuration the shaped charge device 40 is arranged substantially perpendicular to the completion and shaped charge device 41 is inclined towards shaped charge 40 to afford a convergence angle 45, such that the cutting jets 42 and 43 intersect or collide at point 44 which occurs at substantially the final length of the cutting jets. It will be appreciated that in alternative arrangements of devices 40 and 41, jets 42 and 43 may be arranged to intersect beyond the final length of the cutting jets.

Figure 6:
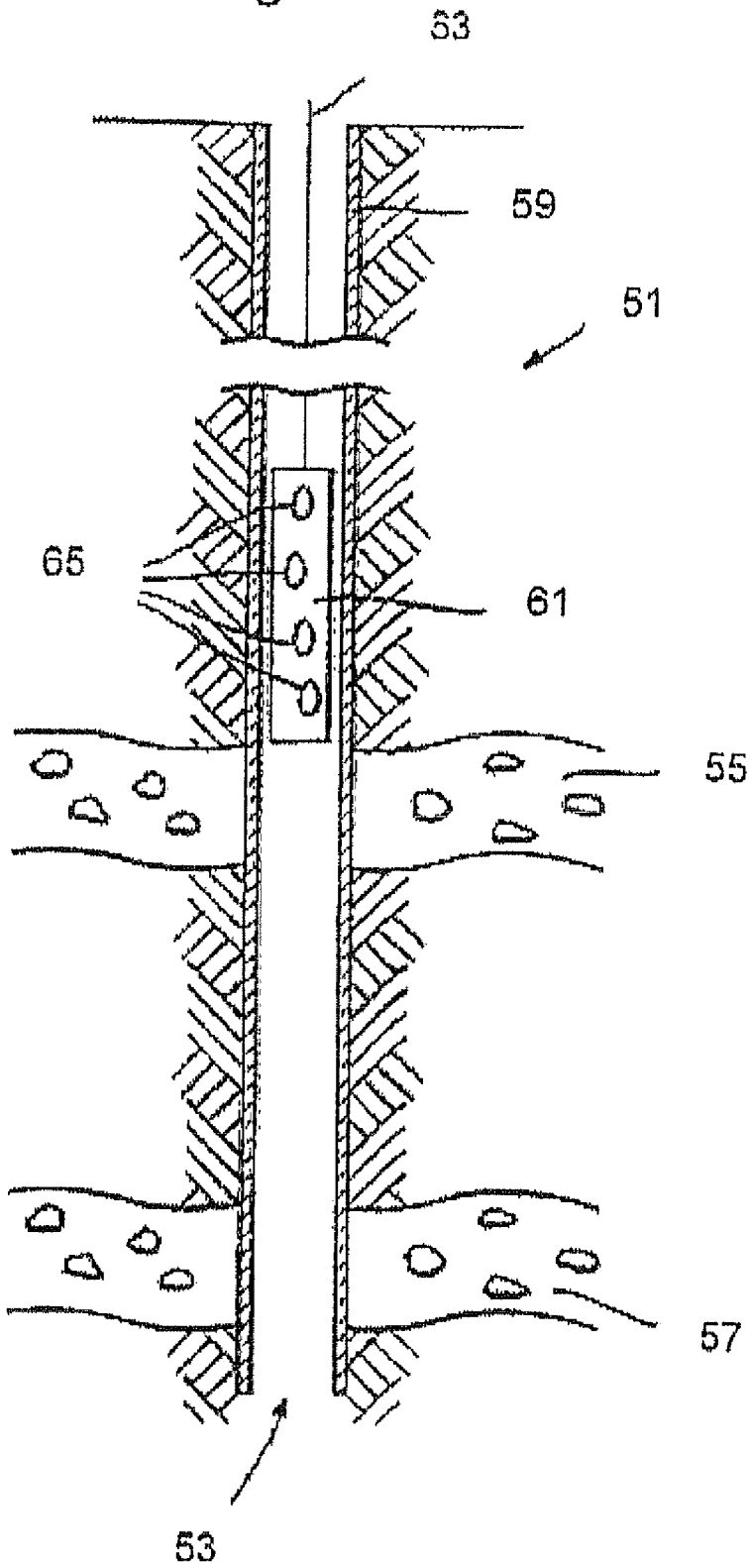
FIG. 6 is a sectional view of a completion in which a gun or carrier according to an embodiment of the invention is shown.

With reference to FIG. 6, there is shown a stage in the completion of a well 51 in which, the well bore 53 has been drilled into a pair of producing zones 55, 57 in, respectively, unconsolidated and consolidated formations. A steel tubular or casing of steel is cemented within the bore 3 and in order to provide a flow path from the production zones 5, 7 into the eventual annulus that will be formed between the casing 59 and production tubing (not shown) which will be present within the completed well, it is necessary to perforate the casing 59. In order to form perforations in the casing 59, a gun 61 containing ports 65, which house the shaped charges, is lowered into the casing on a wireline, slickline or coiled tubing 63, as appropriate.

Figure 7:
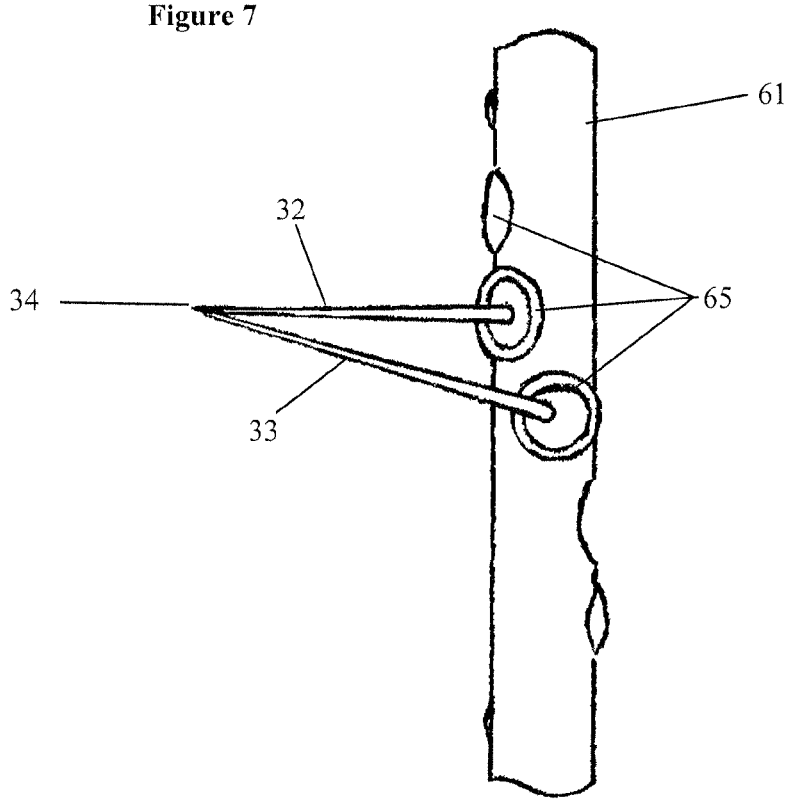
FIGS. 7 and 8 are side views of a gun or carrier according to an embodiment of the invention.

With reference to FIG. 7, there is shown a carrier or gun 61, which contains a row of helically arranged ports 65. Within each port 65 is located a shaped charge perforator (not shown), of the type indicated in FIG. 1, wherein two of the perforators are arranged such that the jets 32 and 33 converge and meet at their maximum extent, at a point 34.

Figure 8:
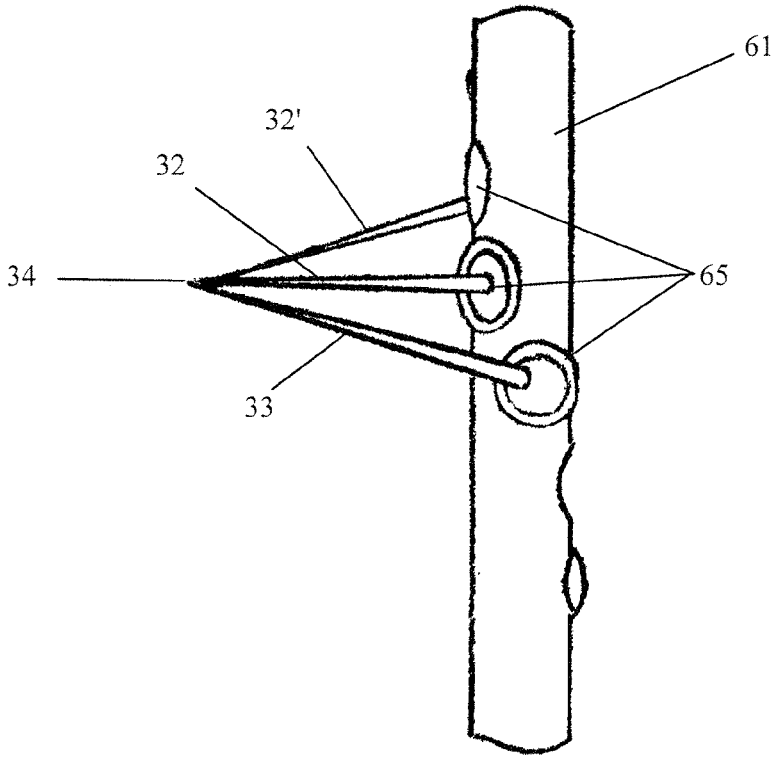

With reference to FIG. 8, there is shown a carrier or gun 61, which contains a row of helically arranged ports 65. Within each port 65 is located a shape charge perforator (not shown), of the type indicated in FIG. 1, wherein three of the perforators are arranged such that the jets 32, 32' and 33 converge and meet at their maximum extent, at a point 34.

It will be readily appreciated that the amount of energy released from the collision of the two cutting jets 22, 23, 32, 33, or 42, 43 will decrease in relation to the distance the that the collision point 24, 34 or 44 occurs from the source of the shaped charge devices 20, 21, 30, 31 or 40, 41.

Modifications to the invention as specifically described will be apparent to those skilled in the art, and are to be considered as falling within the scope of the invention.

The invention claimed is:

1. A method of improving fluid outflow from a well comprising the steps of using at least three shaped charge perforators arranged in a helical arrangement, wherein at least two of said perforators are initiated at substantially the same time and are arranged to produce cutting jets which are convergent, such that in use the cutting jets collide at a point substantially at a maximum extent of said cutting jets, to cause a large cavity at the point of collision.

2. The method as claimed in claim 1, wherein the angle of convergence is in the range of 1 to 179 degrees.

3. The method as claimed in claim 2, wherein the angle of convergence is in the range of 5 to 60 degrees.

4. The method as claimed in claim 1, wherein at least one of the at least two perforators is positioned substantially perpendicularly to the completion casing.

5. The method as claimed in claim 1, wherein the at least two perforators are located less than three charge diameters apart.

6. The method as claimed in claim 5, wherein the at least two perforators are located less than one half charge diameter apart.

7. A perforation gun comprising a plurality of shaped charge perforators, wherein at least three shaped charge perforators are arranged in a helical arrangement, wherein at least two of said perforators are configured such that in use the cutting jets produced by said perforators are convergent to carry out the method of claim 1.

8. A perforation gun as claimed in claim 7, wherein the at least two perforators are arranged to provide cutting jets that have an angle of convergence of between 1 and 179 degrees.

9. The perforation gun as claimed in claim 8, wherein the angle of convergence is between 5 and 60 degrees.

10. A method according to claim 1, wherein the cutting jets collide at a point substantially at the maximum achievable extent of said cutting jets.

11. A method of improving fluid outflow from a well comprising the steps of using a plurality of shaped charge perforators arranged in a helical arrangement, wherein at least three of said perforators are initiated at substantially the same time and are arranged to produce cutting jets which are convergent, such that in use the cutting jets collide at a point substantially at the maximum extent of said cutting jets, to cause a large cavity at the point of collision.

12. A method according to claim 11, wherein the cutting jets collide at a point substantially at the maximum achievable extent of said cutting jets.

* * * * *